US010291974B2

(12) United States Patent
Scheimberg

(10) Patent No.: US 10,291,974 B2
(45) Date of Patent: May 14, 2019

(54) AMBIDEXTROUS EARPIECE MOLD

(71) Applicant: Ruben Scheimberg, Santa Clarita, CA (US)

(72) Inventor: Ruben Scheimberg, Santa Clarita, CA (US)

( * ) Notice: Subject to any disclaimer, the term of this patent is extended or adjusted under 35 U.S.C. 154(b) by 63 days.

(21) Appl. No.: 15/636,607

(22) Filed: Jun. 28, 2017

(65) Prior Publication Data

US 2019/0007760 A1 Jan. 3, 2019

(51) Int. Cl.
*H04R 1/10* (2006.01)

(52) U.S. Cl.
CPC ..... *H04R 1/1016* (2013.01); *H04R 1/1058* (2013.01); *H04R 1/10* (2013.01); *H04R 1/105* (2013.01); *H04R 2201/109* (2013.01)

(58) Field of Classification Search
CPC ..... H04R 25/652; A61F 2011/085
See application file for complete search history.

(56) References Cited

U.S. PATENT DOCUMENTS 2,419,471 A * 4/1947 Thibos ..... A61B 7/04 381/67
4,554,993 A * 11/1985 Houng ..... H04M 1/05 181/130
4,724,922 A * 2/1988 Kalayjian ..... G10K 11/22 181/130
5,824,968 A * 10/1998 Packard ..... A61B 7/02 181/131

(Continued)

*Primary Examiner* — Curtis A Kuntz
*Assistant Examiner* — Ryan Robinson
(74) *Attorney, Agent, or Firm* — The Keith Miller Law Group; Keith Miller

(57) ABSTRACT

An earpiece including: two opposing protrusions designed to fit into the opening of a user's ear canal; a passageway running fully through the protrusions, wherein the passageway is designed to allow sound waves to enter the user's ear canal through the protrusions, wherein the passageway passes from one protrusion through the other protrusion in a manner that would allow sound waves to enter a user's ear canal through the passage with either protrusion inserted into the opening of a user's ear canal; two flexible tube attachment adapters attached to the opening of the passageway in each protrusion, wherein the flexible tube attachment adapters are designed to temporarily attach a flexible tube adapted to transmit sound waves in fluid communication with the passageway. The earpiece of the preferred embodiments is preferably designed to provide an ambidextrous earpiece for use as a hands-free audio earpiece for use with radios, music players, and any other suitable devices; where the earpiece can be used in the user's left ear and right ear with a flexible audio tube inserted into the outer flexible tube attachment adapter and with the opposite end of the flexible tube attached to a speaker to transmit audio into the earpiece and then into the user's ear canal; where the ambidextrous use of the earpiece allows the manufacturer and the user to create and use only one earpiece design for either of the user's ears, which preferably reduces cost and complexity for the manufacturer, eases acquisitions for organizations requiring multiple earpieces, and allows interchangeability for the user.

19 Claims, 2 Drawing Sheets

(56) References Cited

U.S. PATENT DOCUMENTS

| | | | | |
|---|---|---|---|---|
| 7,349,550 | B2 * | 3/2008 | Oliveira | H04R 1/10 381/374 |
| 7,394,910 | B2 * | 7/2008 | Smith | H04R 1/1016 381/322 |
| 7,600,604 | B2 * | 10/2009 | Babcock | A61F 11/08 128/864 |
| 7,844,065 | B2 * | 11/2010 | von Dombrowski | H04R 25/48 381/328 |
| 8,160,288 | B2 * | 4/2012 | Axelsson | H04R 1/1016 128/864 |
| 8,385,577 | B2 * | 2/2013 | Fickweiler | H04R 25/652 381/328 |

* cited by examiner

AMBIDEXTROUS EARPIECE MOLD

DESCRIPTION OF THE PREFERRED EMBODIMENTS

This description of the invention is designed to enable someone with skill in the prior art to make and use the invention, however it also does not limit the invention to these embodiments.

1. First Preferred Embodiment

Figure 1:
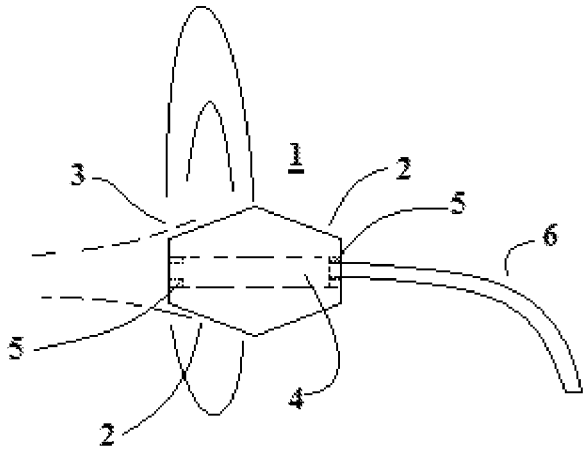
FIG. 1 is a schematic representation of the system of the first preferred embodiments.

As shown in FIG. 1, the system of the preferred embodiments is an earpiece 1 including: two opposing protrusions 2 designed to fit into the opening of a user's ear canal 3; a passageway 4 running fully through the protrusions 2, wherein the passageway 4 is designed to allow sound waves to enter the user's ear canal 3 through the protrusions 2, wherein the passageway 4 passes from one protrusion 2 through the other protrusion 2 in a manner that would allow sound waves to enter a user's ear canal 3 through the passage with either protrusion 2 inserted into the opening of a user's ear canal 3; two flexible tube attachment adapter 5s attached to the opening of the passageway 4 in each protrusion, wherein the flexible tube attachment adapter 5s are designed to temporarily attach a flexible tube 6 adapted to transmit sound waves in fluid communication with the passageway 4. The earpiece 1 of the preferred embodiments is preferably designed to provide an ambidextrous earpiece 1 for use as a hands-free audio earpiece 1 for use with radios, music players, and any other suitable devices; where the earpiece 1 can be used in the user's left ear and right ear with a flexible audio tube inserted into the outer flexible tube attachment adapter 5 and with the distal end 9 of the flexible tube 6 attached to a speaker 10 to transmit audio into the earpiece 1 and then into the user's ear canal 3; where the ambidextrous use of the earpiece 1 allows the manufacturer and the user to create and use only one earpiece 1 design for either of the user's ears, which preferably reduces cost and complexity for the manufacturer, eases acquisitions for organizations requiring multiple earpiece 1s, and allows interchangeability for the user. There may, however, be any intended use and benefits for the system of the preferred embodiments.

Figure 2:
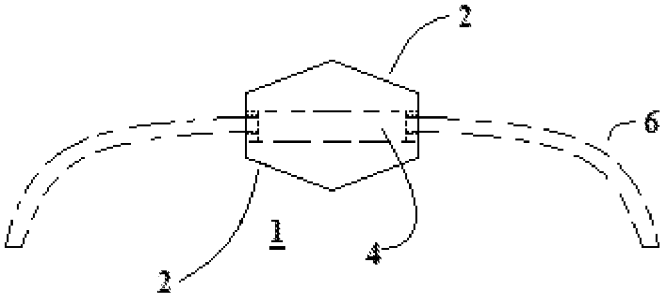
FIG. 2 is a schematic representation of the system of the first preferred embodiments, wherein the ambidextrous attachment of the flexible tube is displayed.

As shown in FIG. 1, the earpiece 1 of the preferred embodiments includes two protrusions 2 projecting in opposite directions and both designed to insert into the opening of the user's ear canal 3. The passageway 4 extends through both protrusions 2, and a flexible tube attachment adapter 5 is attached to the outer segment of both ends of the passageway 4, allowing the flexible tube 6 to be temporarily attached to either protrusion. This allows either protrusion 2 to be inserted into the user's ear canal 3 while, as shown in FIG. 2, the flexible tube 6 can be temporarily attached to the opposite end of the passageway 4 regardless of which protrusion 2 is inserted into the opening of the user's ear canal 3, making the earpiece 1 ambidextrous.

Figure 3:
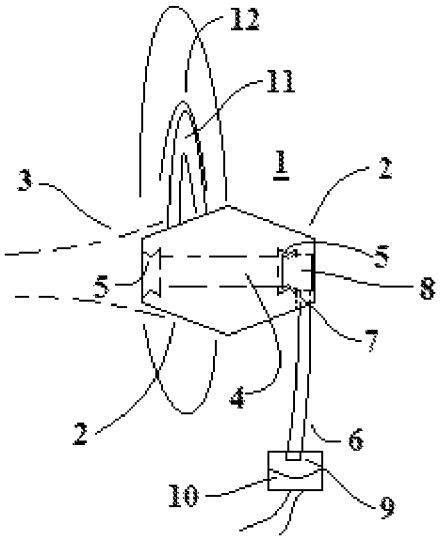
FIG. 3 is a schematic representation of the system of the first preferred embodiments, wherein the tab, groove, and other features are shown.

As shown in FIG. 3, in a preferred variation of the system of the preferred embodiments, a groove 7 extending through the end of each protrusion 2 and into the passageway 4 provides a relief to allow the flexible tube 6 to be attached to the flexible tube attachment adapter 5 roughly perpendicular to the passageway 4, allowing the flexible tube 6 to extend through the groove 7 in the protrusion 2 when attached, while preventing the flexible tube 6 from extending significantly past the end of the protrusion 2 when attached to the flexible tube attachment adapter 5. As shown in FIG. 3, in a preferred variation there is preferably a male adapter 8 attached to one end of the flexible tube 6 and designed so that the male adapter 8 attaches to the flexible tube attachment adapter 5 roughly perpendicular to the axis of the flexible tube 6 attached to the male adapter 8, allowing the flexible tube 6 to be temporarily attached to the earpiece 1 roughly perpendicular to the passageway 4, and in a preferred variation, passing through the groove 7. This preferably keeps the earpiece 1 and flexible tube 6 assembly compact and discrete while in use. There may, however, be any suitable use for the groove 7 and perpendicular attachment assembly, or no groove 7 at all.

As shown in FIG. 3, in a preferred variation, the earpiece 1 further includes a tab 11 attached roughly at the mid-line between the two protrusions 2, and extending roughly perpendicularly to the passageway 4 and the center axis of the protrusions 2, where the tab 11 is preferably designed to help hold and brace the earpiece 1 in the user's ear. In a preferred variation, the tab 11 is designed to brace against the underside of the antihelix 12 of the user's ear in order to securely keep the earpiece 1 in place. In a preferred variation, the outer surface of the tab 11 is curved and contoured to better fit under the antihelix 12 of the user's ear. There may, however, be any suitable design for the tab 11. There may, however, be any suitable means for securing the earpiece 1 in the user's ear and may be no tab 11 at all. There may, however, be no extra means for securing the earpiece 1 in the user's ear at all.

As shown in FIG. 3, in a preferred variation the distal end 9 of the flexible tube 6 from that temporarily attached to the earpiece 1 is preferably attached to a speaker 10 or other audio transducer or device for producing audio. Preferably the sound waves travel through the flexible tube 6, through the flexible tube attachment adapter 5, into the passageway 4, and through the protrusion 2 into the user's ear canal 3, allowing the audio device to provide sound waves to the user's ear canal 3 through the earpiece 1 assembly. There may, however, be any suitable means for providing sound to the earpiece 1 assembly. There may, however, be any suitable use for the earpiece 1 assembly.

Figure 4:
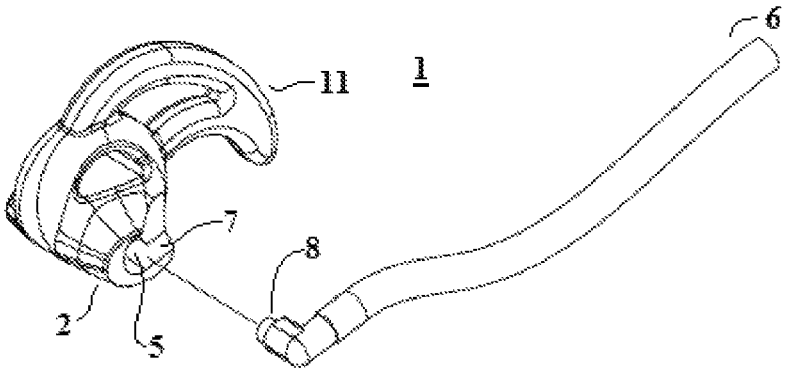
FIG. 4 is a perspective view of the system of the first preferred embodiments, wherein the flexible tube is shown disconnected with its male adapter in position to temporarily attach to the earpiece flexible tube attachment adapter.

As shown in FIGS. 2 and 4, the protrusions 2 preferably have a convergent outer surface designed to fit into the opening of the user's ear canal 3. In a preferred variation, the convergent outer surface of the protrusions 2 are at least one of roughly conical and roughly frusto-conical in shape. There may, however, be any suitable shape for the outer surface of the protrusions 2.

In a preferred variation of the system of the preferred embodiments, the earpiece 1 is designed for use with a two-way radio, allowing audio output from a speaker 10 in communication with the two-way radio to be transmitted to the user's ear, while keeping the assembly relatively discreet from the outside. In the prior art, there has never been an ambidextrous earpiece 1 that can be used in either ear while also bracing against the structure of the user's outer ear and attaching to a flexible audio tube. The vast majority of earpiece 1s used in discreet applications with two-way radios use flexible audio tubes to transmit sound waves from a speaker 10 into the user's ear, and also use brace structures that brace against the user's outer ear, generally the underside of the antihelix 12, where the brace structures keep the earpiece 1 secure during user movement; these two features cannot be used ambidextrously in any prior art design because the only way the brace structure can work properly on the left and right ear is if it is flipped over, and this requires two protrusions 2 capable of being inserted into the user's ear canal 3 on opposite sides, and the ability to relocate the flexible tube 6. Creating an ambidextrous earpiece 1 greatly reduces cost, manufacturing requirements, supply logistics, cost for organizations buying multiple earpiece 1s, cost for users who may wish to wear single earpiece 1s at a time but may want to wear them in either ear, and provides many other benefits that have clearly existed for years but have never been fulfilled. All prior designs using flexible audio tubes and outer ear bracing structures inherently teach against the ability to create an ambidextrous earpiece 1. There may, however, be any suitable benefits and any suitable use for the system of the preferred embodiments.

The earpiece 1 is preferably constructed of a molded polymer material. Preferably the material is slightly flexible. In a preferred variation the earpiece 1 is molded of a silicone material. There may, however, be any suitable material used in the construction of the earpiece 1.

The preceding description, claims, and drawings would be known to an individual skilled in the prior art to allow modifications and changes to these embodiments without breaking the scope of this invention as defined by the claims.

I claim:

1. An earpiece comprising: two opposing protrusions adapted to fit into an opening of a user's ear canal; a passageway running fully through the protrusions, wherein the passageway is adapted to allow sound waves to enter the user's ear canal through the protrusions, wherein the passageway passes from one protrusion through the other protrusion in a manner that would allow sound waves to enter a user's ear canal through the passageway with either protrusion inserted into the opening of a user's ear canal, wherein a groove extends from an end of the protrusion where it enters the opening to the user's ear canal towards the opposite protrusion, wherein the groove is open to the passageway and open to a side of the protrusion; two flexible tube attachment adapters attached to an opening of the passageway in each protrusion, wherein the flexible tube attachment adapters are adapted to temporarily attach a flexible tube adapted to transmit sound waves in fluid communication with the passageway, wherein the flexible tube can pass through the groove roughly perpendicular to the passageway and into the passageway.

2. The earpiece of claim 1, wherein a male adapter is attached to an end of a flexible tube, wherein the male adapter is adapted to attach to the flexible tube attachment adapter roughly perpendicular to the end of the flexible tube, wherein when the male adapter is temporarily attached to the flexible tube attachment adapter, the flexible tube is held in fluid communication with the passageway through the protrusions, and wherein the flexible tube protrudes through the groove in a wall of the protrusion.

3. The earpiece of claim 1, wherein a distal end of the flexible tube is attached to an opening of a speaker, allowing sound transmission from the speaker through the flexible tube, through the passageway in the protrusions and into the user's ear.

4. The earpiece of claim 2, wherein a distal end of the flexible tube is attached to an opening of a speaker, allowing sound transmission from the speaker through the flexible tube, through the passageway in the protrusions and into the user's ear.

5. The earpiece of claim 1, further comprising a tab extending roughly perpendicular to the two protrusions from roughly the mid-line between the two protrusions, wherein the tab is shaped to fit the structure of the user's ear to help retain the earpiece in place with one of the protrusions in the opening of the user's ear canal, wherein the two protrusions and two flexible tube attachment adapters allow the flexible tube to be temporarily attached to either protrusion, permitting the earpiece to be placed in either the user's left or right ear while the tab still properly fits the user's ear to hold the earpiece in place, and the flexible tube can be temporarily attached to an outer opening of the passageway whether the earpiece is used in the user's left ear or right ear.

6. The earpiece of claim 2, further comprising a tab extending roughly perpendicular to the two protrusions from roughly the mid-line between the two protrusions, wherein the tab is shaped to fit the structure of the user's ear to help retain the earpiece in place with one of the protrusions in the opening of the user's ear canal, wherein the two protrusions and two flexible tube attachment adapters allow the flexible tube to be temporarily attached to either protrusion, permitting the earpiece to be placed in either the user's left or right ear while the tab still properly fits the user's ear to hold the earpiece in place, and the flexible tube can be temporarily attached to an outer opening of the passageway whether the earpiece is used in the user's left ear or right ear.

7. The earpiece of claim 3, further comprising a tab extending roughly perpendicular to the two protrusions from roughly the mid-line between the two protrusions, wherein the tab is shaped to fit the structure of the user's ear to help retain the earpiece in place with one of the protrusions in the opening of the user's ear canal, wherein the two protrusions and two flexible tube attachment adapters allow the flexible tube to be temporarily attached to either protrusion, permitting the earpiece to be placed in either the user's left or right ear while the tab still properly fits the user's ear to hold the earpiece in place, and the flexible tube can be temporarily attached to an outer opening of the passageway whether the earpiece is used in the user's left ear or right ear.

8. The earpiece of claim 4, further comprising a tab extending roughly perpendicular to the two protrusions from roughly the mid-line between the two protrusions, wherein the tab is shaped to fit the structure of the user's ear to help retain the earpiece in place with one of the protrusions in the opening of the user's ear canal, wherein the two protrusions and two flexible tube attachment adapters allow the flexible tube to be temporarily attached to either protrusion, permitting the earpiece to be placed in either the user's left or right ear while the tab still properly fits the user's ear to hold the earpiece in place, and the flexible tube can be temporarily attached to an outer opening of the passageway whether the earpiece is used in the user's left ear or right ear.

9. The earpiece of claim 5, wherein the tab braces against the underside of an antihelix of the user's ear, wherein the tab is shaped to brace under the antihelix of the user's ear, wherein the earpiece can be used ambidextrously because of the two protrusions and two flexible tube attachment adapters.

10. The earpiece of claim 6, wherein the tab braces against the underside of an antihelix of the user's ear, wherein the tab is shaped to brace under the antihelix of the user's ear, wherein the earpiece can be used ambidextrously because of the two protrusions and two flexible tube attachment adapters.

11. The earpiece of claim 7, wherein the tab braces against the underside of an antihelix of the user's ear, wherein the tab is shaped to brace under the antihelix of the user's ear, wherein the earpiece can be used ambidextrously because of the two protrusions and two flexible tube attachment adapters.

12. The earpiece of claim 8, wherein the tab braces against the underside of an antihelix of the user's ear, wherein the tab is shaped to brace under the antihelix of the user's ear, wherein the earpiece can be used ambidextrously because of the two protrusions and two flexible tube attachment adapters.

13. The earpiece of claim 1, wherein the protrusions have an outer surface shape that is convergent towards their outer ends at an opening of the passageways where the protrusions enter the opening of the user's ear canal, wherein the convergent shape is at least one roughly conical and roughly frusto-conical.

14. The earpiece of claim 12, wherein the protrusions have an outer surface shape that is convergent towards their outer ends at an opening of the passageways where the protrusions enter the opening of the user's ear canal, wherein the convergent shape is at least one roughly conical and roughly frusto-conical.

15. An earpiece comprising:

two opposing protrusions adapted to fit into an opening of a user's ear canal;

a passageway running fully through the protrusions, wherein the passageway is adapted to allow sound waves to enter the user's ear canal through the protrusions, wherein the passageway passes from one protrusion through the other protrusion in a manner that would allow sound waves to enter a user's ear canal through the passageway with either protrusion inserted into the opening of a user's ear canal, a groove extending from an end of the protrusion where it enters the opening to the user's ear canal towards the opposite protrusion, wherein the groove is open to the passageway and open to a side of the protrusion;

two flexible tube attachment adapters attached to an opening of the passageway in each protrusion, wherein the flexible tube attachment adapters are adapted to temporarily attach a flexible tube adapted to transmit sound waves in fluid communication with the passageway, wherein the flexible tube can pass through the groove roughly perpendicular to the passageway and into the passageway; and a tab extending roughly perpendicular to the two protrusions from roughly the mid-line between the two protrusions, wherein the tab is shaped to fit the structure of the user's ear to help retain the earpiece in place with one of the protrusions in the opening of the user's ear canal, wherein the dual two protrusions and dual two flexible tube attachment adapters allow the flexible tube to be temporarily attached to either protrusion, permitting the earpiece to be placed in either the user's left or right ear while the tab still properly fits the user's ear to hold the earpiece in place, and the flexible tube can be temporarily attached to an outer opening of the passageway whether the earpiece is used in the user's left ear or right ear.

16. The earpiece of claim 15, wherein a male adapter is attached to an end of a flexible tube, wherein the male adapter is adapted to attach to the flexible tube attachment adapter roughly perpendicular to the end of the flexible tube, wherein when the male adapter is temporarily attached to the flexible tube attachment adapter, the flexible tube is held in fluid communication with the passageway through the protrusions, and wherein the flexible tube protrudes through the groove in a wall of the protrusion.

17. The earpiece of claim 15, wherein a distal end of the flexible tube is attached to an opening of a speaker, allowing sound transmission from the speaker through the flexible tube, through the passageway in the protrusions and into the user's ear.

18. The earpiece of claim 15, wherein the tab braces against the underside of an antihelix of the user's ear, wherein the tab is shaped to brace under the antihelix of the user's ear, wherein the earpiece can be used ambidextrously because of the dual two protrusions and dual two flexible tube attachment adapters.

19. The earpiece of claim 18, wherein the protrusions have an outer surface shape that is convergent towards their outer ends at an opening of the passageways where the protrusions enter the opening of the user's ear canal, wherein the convergent shape is at least one roughly conical and roughly frusto-conical.

* * * * *